US005238156A

United States Patent [19]

Andris

[11] Patent Number: 5,238,156

[45] Date of Patent: Aug. 24, 1993

[54] METERING AND SPRAY PUMP FOR DISPENSING LIQUID, LOW-VISCOSITY, AND PASTY SUBSTANCES

[75] Inventor: Raimund Andris, Villingen-Schwenningen, Fed. Rep. of Germany

[73] Assignee: Firma Raimund Andris GmbH & Co., KG., Villingen-Schwenningen, Fed. Rep. of Germany

[21] Appl. No.: 810,839

[22] Filed: Dec. 20, 1991

[30] Foreign Application Priority Data

Dec. 21, 1990 [DE] Fed. Rep. of Germany ..... 4041136

[51] Int. Cl.[5] ..... B65D 37/00

[52] U.S. Cl. ..... 222/207; 222/209; 222/321; 222/383

[58] Field of Search ..... 222/207, 209, 321, 383

[56] References Cited

U.S. PATENT DOCUMENTS

| | | | |
|---|---|---|---|
| 2,824,672 | 2/1958 | Wersching | 222/207 |
| 3,124,275 | 3/1964 | Lake | 222/321 X |
| 4,732,549 | 3/1988 | von Schuckmann | 222/207 X |
| 4,863,070 | 9/1989 | Andris | 202/207 |
| 4,979,646 | 12/1990 | Andris | 222/207 X |
| 5,014,881 | 5/1991 | Andris | 222/207 |

FOREIGN PATENT DOCUMENTS

| | | | |
|---|---|---|---|
| 0394750 | 10/1990 | European Pat. Off. | 222/383 |

*Primary Examiner*—Andres Kashnikow

*Assistant Examiner*—Joseph A. Kaufman

*Attorney, Agent, or Firm*—McGlew and Tuttle

[57] ABSTRACT

In a metering and spray pump for liquid, low-viscosity and pasty substances, an elastic bellows 3 is arranged between two plastic housing parts 1, 2 that are telescopingly movable relative to one another, connecting them. The bellows, acting as a discharge valve 18, has, at one end, a valve annular wall 15 that surrounds the generated surface 17 of an inner annular discharge seat 8 made in one piece with the first housing part 1 in a sealing manner and such that it can be lifted off. As a suction valve 58, the bellows 3 has, at its other end, a valve annular wall 54 which is in sealing and separable contact with the generated surface 43 of a valve seat 42 made in one piece with the second housing part 2 such that it can be lifted off, and the medium to be pumped is drawn into the bellows 3 through the valve seat. To guarantee high reliability of operation, especially good closing quality at weak valve opening forces, where the quality of closing can be tested even in the dry state, with the smallest possible number of simple and easy-to-assemble individual parts, the valve annular wall 15 of the discharge valve 18 and the valve annular wall 54 of the suction valve 58, which valve annular wall 54 is provided with a closed front wall 57, are each in contact with conical or hemispherical generated surfaces 17, 43, wherein both valve annular walls 15, 54 are connected to the bellows 3 both radially elastically and elastically movably in the axial direction.

18 Claims, 2 Drawing Sheets

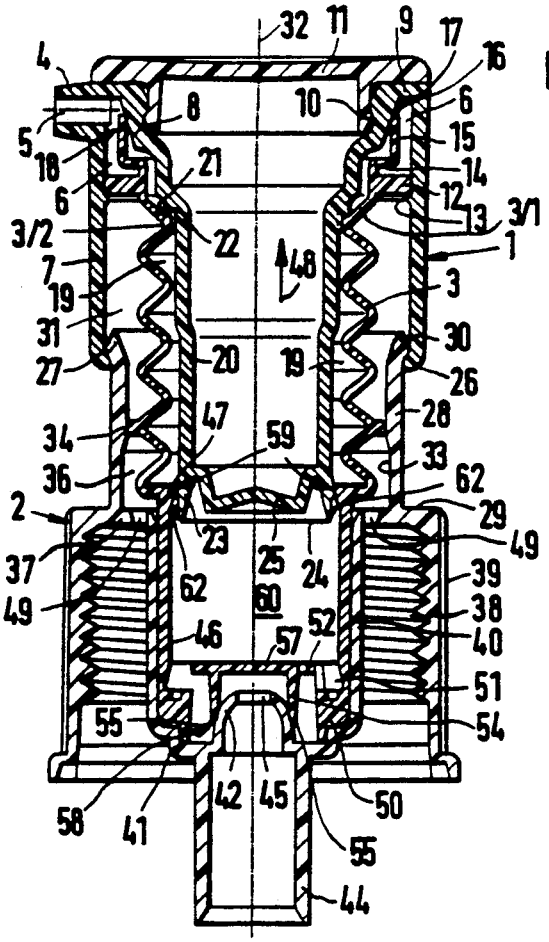
Fig.1
Fig.3
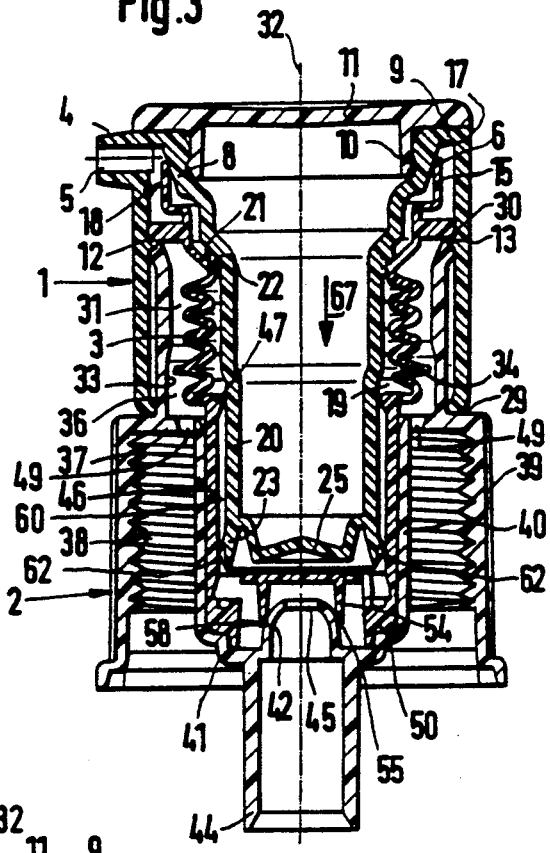
Fig.2
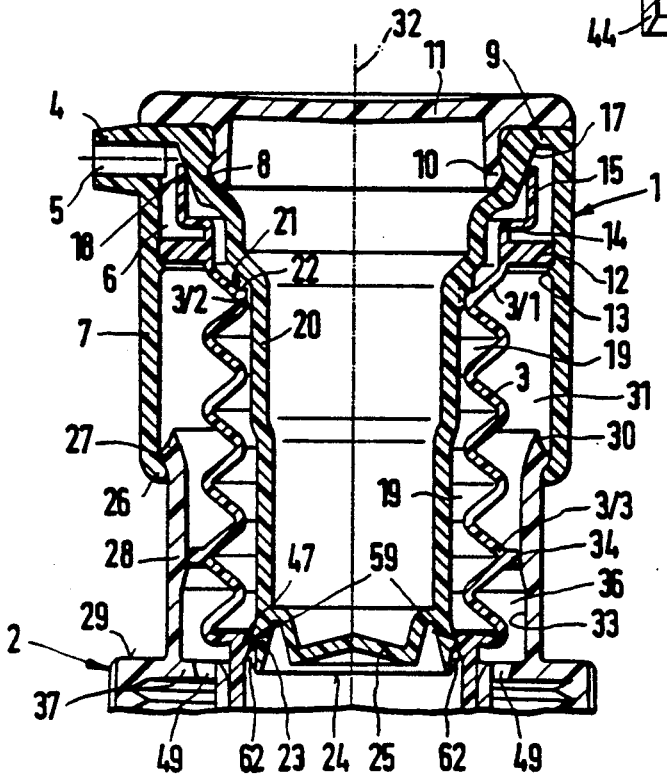

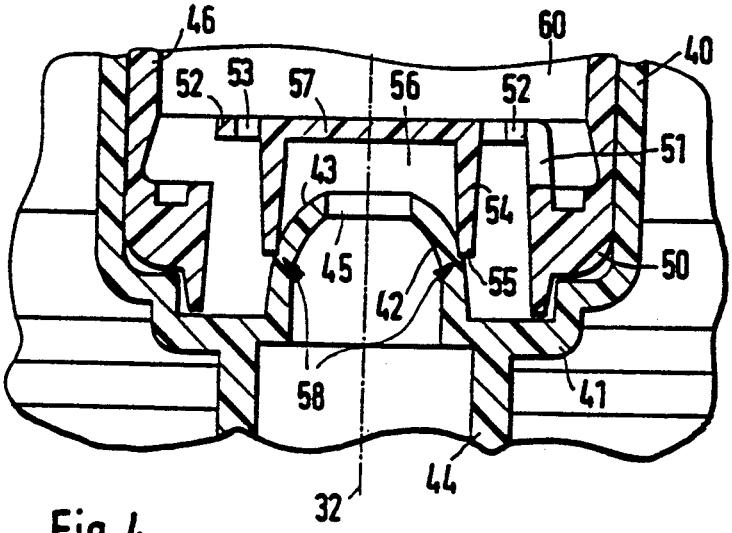
Fig.4
Fig.5
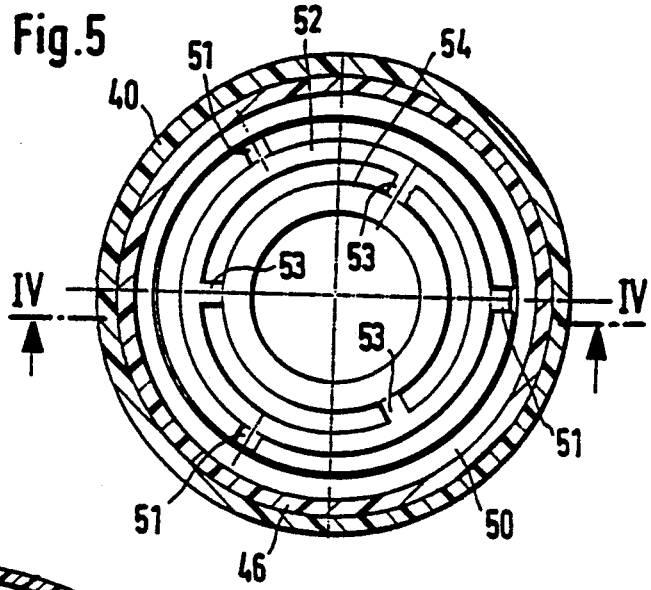
Fig.6
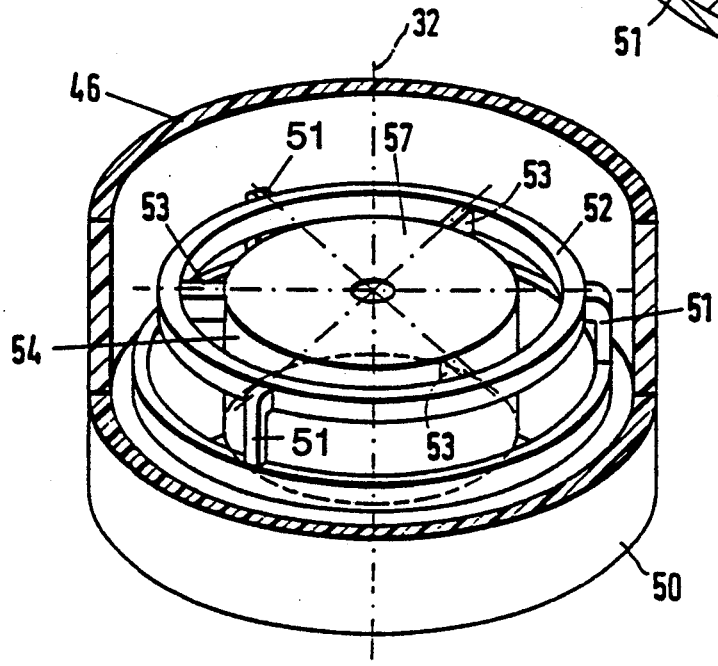

METERING AND SPRAY PUMP FOR DISPENSING LIQUID, LOW-VISCOSITY, AND PASTY SUBSTANCES

FIELD OF THE INVENTION

The present invention pertains to a metering and spray pump for dispensing liquid, low-viscosity, and pasty substances from bottle- or can-like containers and in particular to a pump, with a bellows made of an elastic material, which is arranged connectingly between two housing parts made of a dimensionally stable plastic that are telescopingly movable relative to one another. The pump has a discharge valve at one end. A sleeve-like discharge valve annular wall sealingly surrounds a generated surface of a round annular discharge seat made in one piece with the first housing part. When performing the pump stroke the valve annular wall can be lifted off the generated surface. A suction valve, at the other end of the pump, has a likewise sleeve-like suction valve ring wall which is in sealing contact with the generated surface of a round valve seat made in one piece with the second housing part. The sleeve-like valve ring wall can be lifted off, and the medium to be pumped is drawn through the valve seat from the container into the bellows.

BACKGROUND OF THE INVENTION

In a similar prior-art metering and spray pump of this class (DE 38,28,811 A1), the valve annular wall that sealingly surrounds the cylindrical generated surface of a projection forming the valve seat of the discharge valve is elastic only radially and can consequently be lifted off only radially. The valve annular walls of the suction valves provided in different designs that can also only be lifted off elastically in the radial direction from the cylindrical generated surfaces forming their valve seat during the suction stroke in order for the medium drawn in to be able to flow into the interior space of the bellows between the corresponding generated surface and the valve annular wall surrounding it.

Such discharge and suction valves have proved to be unsatisfactory in practice for metering and spray pumps of this class especially because an excessive opening pressure is necessary in the case of adequately closing force on the one hand, and on the other hand, because the quality of sealing may be compromised by particles that may become lodged between the valve annular wall and the generated surface surrounded by it. Given the small size of the parts of such pumps—the diameter of a bellows is ca. 12–15 mm and its length is ca. 30 mm—the precision of manufacture is also often insufficient to guarantee the necessary quality of closing of the valves, especially for liquid media. Even small deviations in dimension, in the range of one hundredth of one mm, may lead to rejects.

The other embodiments of suction valves which can be found in the same document, have tongue- or plate-like closing members to cover axial bores, and also fail to meet the requirements imposed on such pumps in terms of reliability of operation.

The sealing or closing quality of the valves is also decisive for performing, especially on automatic assembly machines, a dry function test in which these valves must prove to be air-tight. Moreover containers that are equipped with such metering and spray pumps are subjected, for safety's sake, to drop tests, in which the valves also must prove to close reliably in order to pass the test.

Another decisive property which such metering and spray pumps must possess, is the possibility of manufacturing them economically. Since they are produced in very large lots, it is necessary for them to consist of the smallest possible number of individual parts with economically acceptable manufacturing tolerances, and they should be able to be assembled in the simplest manner possible.

Moreover, the generation of vacuum in the container due to air flowing in during the suction stroke must be avoided in such metering and spray pumps.

In a prior-art metering pump with pump bellows (DE-PS 35,09,178 A1), a ring-like sealing lip is arranged, for the latter purpose, as a radially outwardly directed extension of the lowermost fold of the bellows at the top end of a collar forming the lower end of the bellows. This collar sealingly surrounds an annular collar of the housing part that is or can be connected to the container. In its starting position, the annular sealing lip lies, due to its initial shape, sealingly on the cylindrical inner side of an annular seat, which is made in one piece with the housing part that can be connected to the bottle neck of a container. The function of this sealing lip is that of a one-way valve which allows air to flow into the interior of the container through vent openings during the suction stroke of the pump, on the one hand, but it ensures, on the other hand, that no portion of the liquid or pasty contents of the container will be able to escape to the outside past the outside of the bellows. The vent openings, through which the air drawn in is able to flow into the interior of the container, are arranged in a front wall of the housing part that can be connected to the container. This housing part is usually provided with internal threads which can be screwed onto corresponding external threads of a can- or bottle-like container.

In the case of can- or bottle-like containers, which have high stability of shape that withstands even higher vacuums because of the hardness of their material and/or the wall thickness, there is a risk that the suction function will be compromised if ventilation is insufficient.

However, in the case of containers which are thin-walled and/or consist of a flexible or elastic material, so that they will undergo deformation even under low vacuums, the hitherto known shapes of the annular sealing lips are insufficient for avoiding deformation of the container. This is especially true if the annular sealing lip is to have only a relatively small radial extension in order to obtain a radially compact design. As a result of the elasticity, the opening and closing interplay with the inner surface of the annular wall surrounding it becomes insufficient.

In addition, there is also a risk in the case of thin-walled or readily deformable containers that under the effect of an accidental or unintended radial pressure exerted on the container wall, the annular sealing lip will be subjected inadvertently, as in the case of, e.g., a toothpaste tube, to a much higher pressure in the blocking direction than normally happens when the container with the metering pump attached is brought into the horizontal position or placed upside down. The conventional shapes of the annular sealing lip are no longer able to exert their sealing effect and to withstand the increased pressure in the discharge direction in this case as well. The alternations between air intake under a relatively low vacuum and tight sealing in the opposite direction under increased pressure cannot be achieved solely by shaping or the design of the cross section.

SUMMARY AND OBJECTS OF THE INVENTION

The basic task of the present invention is to improve a metering and spray pump of the above-described class with the smallest possible number of simple, easy-to-assemble, and reliably operating individual parts. The functional elements may be made in one piece with a high reliability of operation, sufficient closing quality with a weak opening force of the discharge and suction valves, and in which the quality of closing can be tested even in the dry state, and guaranteed.

This task is accomplished according to the present invention by the cylindrical discharge valve annular wall of the discharge valve and the likewise cylindrical valve annular wall of the suction valve. The cylindrical valve annular wall is provided with a closed front wall and has an open radially elastic end or peripheral edges in contact with conical or hemispherical generated surfaces of a housing part and surrounds it. Both valve ring walls being connected to the bellows in an axially elastically movable manner. This is due to the valve annular wall of the discharge valve being connected in one piece to the discharge-side end of the bellows via an essentially radially outwardly projecting, elastic annular shoulder, to which the pumping pressure of the medium being pumped can be admitted in the opening direction. The valve annular wall of the suction valve being connected in one piece to the suction-side end of the bellows by a connection ring that is elastic both axially and radially, and by connection webs.

Due to the simultaneous presence of radial elasticity and axial elasticity, the initially linear contact between the valve annular wall and the conical or hemispherical generated surface becomes a two-dimensional contact. During the closing process, the edge of the valve annular wall is pushed in the axial direction onto the generated surface, and particles that may be located between them are be pushed away. The valve annular wall is also able to adapt itself to the shape of the generated surface more easily and in a better sealing manner even in the case of oblique position. It is achieved due to these elasticities of the valve annular walls, which act in different directions, that the closing forces will increase, approximately double, and the opening forces will decrease, approximately to half. This leads to a considerably wider latitude in terms of the required precision of manufacture as well.

Moreover, the opening force of the discharge valve is additionally reduced by the pressure occurring in the medium also acting in the axial opening direction on the elastic annular shoulder.

While it would definitely be possible, albeit with an extra amount of assembly work, to manufacture the valve annular wall of the suction valve as a separate component and to connect it to the bellows with a corresponding connection means, a considerable advantage comes from the suction valve annular wall and its connection members being injection molded in one piece with the bellows. In addition, the connection members selected also guarantee high elasticity, which is advantageous for the desired mode of operation, and functional flexibility.

One embodiment of the invention improves the mode of operation due to support cams applying the pushing force on to the bellows during the discharge stroke, thus keeping the pushing force away from and interfering with the discharge valve annular wall.

A sealing ring between the bellows and the inside of a guide wall of a first housing part, also leads to an advantageous variant of the present invention due to the fact that the sealing of the annular chamber that leads to the discharge nozzle does not exert any adverse effect on the function of the discharge valve annular wall.

The correct closing function of the suction valve is ensured by having the suction seat extending into a suction section of the bellows and having the suction bore being approximately half a diameter of the suction valve wall.

The inclusion of an expanded diameter area of the inner surface of a guide wall of the second housing is suggested to prevent unintended deformation of the container due to the vacuum generated inside the container during the suction stoke even in the case of thin-walled or readily deformable containers on the one hand, and on the other hand, to prevent any portion of the contents of the container from being discharged to the outside when external pressure is applied to the container wall, as long as this pressure does not exceed the limit of destruction.

The particular advantage that is thus achieved is the fact that the annular rib is displaced in the opening direction by the bellows even during the discharge stroke, and it returns to its closed position only at the end of the suction stroke. On the other hand, however, it is also possible to make the annular rib so dimensionally stable that it will withstand an increased pressure in the opposite direction, i.e., in the closing direction, and will not permit any medium to be discharged past it to the outside.

The embodiment of the present invention has a check valve to ensured that no portion of the contents of the container will be able to reach the discharge nozzle through the bellows and the discharge valve when a pressure acting from the outside on the container wall appears or an impact due to dropping occurs.

The prior-art metering pumps of this class fail to guarantee this safety, because the closing member of the discharge-side discharge valve usually rests on its valve seat surface under a weak spring pressure only, so that even a weak force acting in the discharge direction is sufficient for opening it.

Other advantageous embodiments of the present invention, will be explained in greater detail below on the basis of the exemplified embodiments also described in greater detail below, and contribute to obtaining a compact, simple design and simple reliable operation.

It should also be borne in mind that the solution according to the present invention involves no additional costs and requires no additional space, i.e., a low-cost and also compact design is possible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 shows a sectional view of a metering and spray pump in the starting position;

FIG. 2 shows an enlarged portion of FIG. 1;

FIG. 3 shows a sectional view of the metering and spray pump according to FIG. 1 at the end of a discharge stroke of the pump;

FIG. 4 shows an enlarged sectional view IV—IV of the suction valve of FIG. 5;

FIG. 5 shows a top view of FIG. 4; and

FIG. 6 shows an enlarged, partially cut-away perspective view of the suction valve.

DETAILED DESCRIPTION OF THE PREFERRED EMBODIMENT

The drawings show a metering and spray pump intended for dispensing liquid or low-viscosity, especially pasty, substances from bottle- or can-like containers. FIG. 1 shows a usual use position or handling position. It consists of an upper first housing part 1 and a lower second housing part 2 as well as a bellows 3 arranged between and connecting the two housing parts 1 and 2. The top and bottom in the drawing also correspond to the normal handling position.

While the two housing parts and 2 each are made of a dimensionally stable plastic, the bellows 3 consists of a rubber-like elastic plastic, whose elasticity is able to ensure sufficient dimensional stability and a sufficiently strong restoring force for the initial strokes. Both the bellows 3 and the two housing parts 1 and 2 are made in one piece according to an injection molding process.

The housing part 1 is provided with a laterally radially projecting, tubular dispensing nozzle 4, whose discharge canal 5 opens into an annular chamber 6 that is arranged between an outer, cylindrical guide wall 7 and an inner, downwardly conically tapering annular discharge seat 8, and is closed in the upward direction by a front wall 9 connecting these two. A closing cap 11 is provided with a snap-in projection 10. The closing cap closes the top end of the inner annular discharge seat 8, and is placed on the front wall 9 by means of a snap-in connection.

At the end of its topmost annular fold 3/1, the bellows 3 is provided with an external sealing ring 12, which is in sealing contact with the inner surface of the guide wall 7. The sealing ring 12 is immediately above an inner, circumferential, thin rib 13 provided on the guide wall 7. Above the sealing ring 12 and at a small axial distance from it, a radially outwardly projecting, thin-walled and therefore axially elastic annular discharge shoulder 14 is arranged. By the annular shoulder 14 an essentially cylindrical and radially elastic discharge valve annular wall 15 is connected in one piece to the bellows 3 and the sealing ring 12. The discharge valve annular wall 15 lies, with its upper end edge 16, sealingly on the conical generated surface 17 of the inner annular discharge seat 8 under a certain axially as well as radially acting pre-tension. The discharge valve annular wall 15 forms the movable closing member of a discharge valve 18 in cooperation with the inner annular discharge seat 8, and forms the partition between the annular chamber 6 and the interior space 19 of the bellows 3.

The interior space 19 of the bellows 3 is largely filled with a hollow cylindrical displacement body 20 with multiply stepped diameter. The displacement body 20 is made, as an extension, in one piece with the inner annular discharge seat 8 of the housing part 1 and is located all-around at a radially spaced location from the wall of the bellows 3 over its entire length in order for the medium to be dispensed to flow between the displacement body 20 and the wall of the bellows 3.

The displacement body 20 is provided with a plurality of support cams 21, which are distributed on its circumference and are supported on an inner radial shoulder 22 of the topmost inner annular fold 3/2 of said bellows 3 and only in the area of the topmost inner annular fold 3/2.

During the discharge stroke the support cams 21 have the task of keeping the pumping pressure acting in the direction of the arrow 67 away from the upper section of the bellows 3, and also especially away from the discharge valve annular wall 15 and the annular shoulder 14 in order for their function not to be compromised.

At its lower end, the displacement body 20 has a conically expanding edge section 23 that is closed by a front wall 25 that is staggered axially in the upward direction relative to the peripheral edge 24. The displacement body 20 has a smaller diameter than the annular discharge seat 8 over the section which extends as an extension of the conical annular discharge seat 8 into the bellows 3.

A guide wall 7 of the housing part 1 is provided at its lower end, with an inwardly projecting collar 26 that extends in a positive-locking manner behind an outwardly projecting collar 27 of a guide wall 28 of the housing part 2. The two guide walls 7 and 28 are telescopingly guided one inside the other and permit a telescoping axial relative movement relative to one another, which corresponds to one pump stroke. This axial relative movement is limited by axial stops which are formed by the two collars 26 and 27 in one direction, and, in the other direction, by an annular shoulder 29 of the housing 2 on which shoulder 29 the collar 26 of the housing part 1 is seated at the end of the pump stroke.

The collar 27 of the housing part 2 is provided in the upward direction with an insertion collar 30, whose diameter is reduced compared with the circumferential rib 13 of the guide wall 7 and through which the sealing ring 12 is pushed from below over the circumferential rib 13 during assembly. The task of the circumferential rib 13 is to hold the sealing ring 12 in the position shown in the drawing.

The diameters of the collars 26 and 27 and the diameters of the guide walls 7 and 28 are adjusted to one another such that sufficient guiding between the two housing parts 1 and 2 is guaranteed on the one hand, but on the other hand, sufficient exchange of air between the atmosphere and the common interior space 31 of the housing is able to take place at the respective contact points during the stroke movements.

The guide wall 28, which surrounds the bellows 3 at a radially spaced location from it, has an enlarged diameter 33 located beneath the starting position shown in FIGS. 1 and 2 and in the range of axial movement of the second lowest outer annular fold 3/3 of the bellows 3. The enlarged diameter 33 forms in cooperation with an annular rib 34 arranged at the annular fold 3/3 an automatically operating ventilating valve between the common interior space 31 and an air scoop located in the area of the enlarged diameter 33.

Like all components with the exception of the dispensing nozzle 4, the guide wall 28 is made in one piece on an annular web 37 of the housing part 2, concentrically with the common axis 32. A screw cap 39 provided with internal threads 38, by which the entire metering and spray pump can be screwed onto the threaded neck (not shown) of a can- or bottle-like paste or liquid container, is made in one piece with its axial opposite side.

In addition, a cylindrical pot-shaped body 40, whose front-side bottom wall 41 has a central, nipple-like upwardly directed hollow body 42 with a suction bore 45 and with a hemispherical generated surface 43 acting as a suction valve seat, and is provided with a downwardly directed suction connection piece 44, is made concentrically in one piece with the annular web 37 inside the screw cap 39. The suction connection piece 44 may be provided with a suction tube, not shown, to draw in a liquid medium. Containers containing pasty substances are usually provided with a follower piston. A cylinder wall 46 connected in one piece to the bellows 3 is seated in the pot-shaped body 40, fitting it without clearance. A radially inwardly projecting check collar 47 and the annular folds of the bellows are also made in one piece with the top end of the cylinder wall 46.

The above-mentioned annular rib 34 has the task of allowing air to enter vent openings 49, during the suction stroke of the bellows 3, i.e., when the bellows 3 returns from the pump stroke end position shown in FIG. 2 into the starting position shown in FIG. 1 in the direction of arrow 48. Through these vent openings 49 of the annular web 37, the air flows into the interior space of the screw cap 39 or the container, onto which the screw cap 39 is screwed, from the interior space 31 which surrounds the bellows 3. The interior space of the screw cap 39 also communicates with the outside atmosphere due to the connection between the guide walls 7 and 28 not being air-tight. However, the annular rib 34 also has the task of preventing liquid or pasty medium contained in the container from entering the interior space 31 when the container assumes the horizontal position instead of the normal, vertical position, i.e., when it falls over, or if the container is provided with a deformable wall and external pressure is exerted on the deformable wall. Consequently, it has the task of sealingly separating the interior space 31 from the air scoop 36, which is permanently connected to the container via the vent openings 49.

Thus, in cooperation with the inner surface of the guide wall 28, the annular rib 34 forms a ventilating valve, which is open during the stroke movements of the first housing part 1 and is closed in the starting position and has the property of withstanding a relatively high pressure in the sealing direction. The annular rib 34 allows air drawn in to pass through in the direction of suction during the suction stroke of the bellows, without causing a vacuum being generated inside the container, which would be sufficient to deform thin and easily deformable container walls toward the inside.

The above-described design, which causes no additional costs, also leads to a radially highly compact construction.

The cylinder wall 46 of the bellows 3 has a reinforced front wall 50, which is seated on the bottom wall 41 of the pot-shaped body 40. On the front wall 50 a first group of three axially upwardly directed, finger-like connection webs 51, which are staggered by 120° each in the circumferential direction, is made in one piece. The upper ends of the connection webs 51 are made in one piece with a radially as well as axially elastic connection ring 52, which in turn is connected by a second group of connection webs 53, which extend essentially radially and are each staggered by 60° relative to the connection webs 51. The second group of connection webs are connected to a cylindrical suction valve annular wall 54. The suction valve annular wall 54 is provided, at its top end, with a front suction closing wall 57 closing its cavity 56. The suction valve annular wall 54 is made as a thin wall, and is seated, with its lower, open peripheral edge 55, radially elastically and sealingly on the hemispherical generated surface 43 of the hollow body 42. The internal diameter of the suction valve annular wall 54 is approximately twice the diameter of the suction bore 45, but only slightly smaller than the external diameter of the hollow body 42.

Due to the simultaneous radial and axial elasticities of the connection ring 52, the suction valve annular wall 54 is able to lie sealingly on the generated surface 43 even in the case of inaccurate manufacture or oblique position, even if this generated surface were conical rather than hemispherical. This elasticity or spring property of the connection ring 52 also ensures that the suction valve annular wall 54 will automatically return to its closed position after a completed suction stroke. The generated surface 43 of the hollow body 42 and the suction valve annular wall 54 thus form the suction valve 58 of the metering and spray pump, while the discharge valve annular wall 15 forms the discharge valve 18 in cooperation with the inner annular discharge seat 8 of the upper housing part 1.

While the suction valve annular wall 54, the connection webs 51 and 53, and the connection ring 52 are made in one piece with the lower front edge 50 of the bellows 3 in the above-described, preferred embodiment, it is also possible to provide the outer connection webs 51 with another, preferably more stable, ring, which is inserted into a corresponding seat of the front edge 50. The suction valve annular wall 54 would thus be able to be manufactured as a separate component, together with the connection webs 51 and 53, the connection ring 52, and the additional ring.

The elasticity of the material of the bellows 3 also brings about automatic return of the first housing part 1 into its starting position, represented by a solid line, as soon as an axial force ceases to be exerted on it, i.e., when it is released after a discharge stroke performed in the direction of arrow 67. This return movement in the direction of the arrow 48 is the suction stroke, during which the suction valve annular wall 54 is lifted off from the generated surface 43 axially elastically in order for medium to be able to flow from the container into the interior space or pump chamber 60 of the cylinder wall 46 and the annular folds of the bellows 3.

Both the suction valve 58 and the discharge valve 18 open when a pressure acting in the direction of arrow 48, i.e., in the direction of discharge appears. This pressure may also be generated by compression of the possibly thin deformable walls of the container to which the metering and spray pump is attached. There is a risk in the case of such thin-walled containers or containers made with deformable walls that medium will be squeezed out uncontrollably through the metering and spray pump by the pressure effect that deforms the container walls. This may also happen when a container equipped with such a metering and spray pump, dropping head first, hits a hard surface.

To prevent medium from flowing out or being squeezed out inadvertently, the suction valve 58 is followed, in the form of the check collar 47 and the conical, lower edge section 23 of the displacement body 20, by a check valve 59, by which the interior space 60 of the cylinder wall 46 is sealingly separated from the interior space 19 of the annular folds of the bellows 3, as long as the upper housing part 1 is in its upper end position, which is shown in FIG. 1 and FIG. 2. In this position or functioning position, the conical outer surface of the edge section 23 lies sealingly on the check collar 47. However, as soon as the pump stroke, i.e., the movement of the upper housing part 1 in the direction of arrow 57 begins, the conical edge section 23 will be moved away from the collar 47 in the downward direction, so that medium will be able to flow through between the collar 47 and the displacement body 20, which has a smaller diameter in this area, into the interior space 19 of the bellows 3.

During its downward movement in the direction of arrow 67, the displacement body 20 presses the medium located in the interior space 60 first into the interior space 19 of the bellows 3, and then through the discharge valve annular wall 15 of the discharge valve 18 and into the annular chamber 6 and subsequently into the discharge canal 5 of the discharge nozzle 4.

Since the discharge valve annular wall 15 is made in one piece with the outer edge of the likewise thin-walled, and therefore axially elastic, annular shoulder 14, it is also able to perform axial movements relative to the generated surface 17 of the annular discharge seat 8, so that the opening and closing processes can take place more easily and rapidly. However, it is also important that the pressure building up in the medium during the discharge stroke acts on the radial annular shoulder 14 in the opening direction, so that more rapid opening of the discharge valve 18 will take place.

Thus, the displacement body 20 not only has the task of keeping the volume of the interior space 19 of the bellows 3 as small as possible in the area of the annular folds, but it also serves as a check valve once it has assumed its upper end position.

Another function assumed by the displacement body 20 is that the conical edge section 23—to the extent it extends below the collar 47—additionally guides the upper housing part 1 in the lower housing part 2 in cooperation with the cylinder wall 46. To achieve this, the part of the edge section 23 extending below the collar 47 is expanded to a diameter that is at least approximately equal to the internal diameter of the cylinder wall 46. In order for the medium that is to be delivered from the interior space 60 into the interior space 19 to be nevertheless able to flow relatively unhindered in the upward direction along the cylinder wall 46, the part of the edge section 23 that extends below the collar 47 in the starting position is provided on its circumference with a plurality of slit-like cutouts 62. These terminate in a diameter that is smaller than the internal diameter of the collar 47, in order for the check valve function to be preserved.

Due to the fact that the guiding edge section 23 is axially displaced by the stroke length by the likewise guiding collar 26 of the guide wall 7, the two housing parts 1 and 2 are guided one in the other so well even in the starting position (FIG. 1) that the axial stroke movements cannot be hindered without additional guide surfaces overlapping over a rather long section in the axial direction being necessary on the two housing parts 1 and 2.

The design according to the present invention provides a metering and spray pump for liquid and low-viscosity or pasty substances which guarantees trouble-free pumping function at relatively wide tolerances and can be advantageously used even in the case of thin-walled, easily deformable bottle- and can-like containers, and ensures that the container walls will not be deformed in the case of proper handling, and that medium is prevented from being squeezed or flowing uncontrollably out of the container through the metering and spray pump when pressure is incorrectly exerted on a flexible container wall. Due to the improved pumping function, which can be attributed to the special design of the two pump valves 18 and 54, the metering and spray pump according to the present invention can also be used universally for liquid as well as pasty media. Medium is drawn in initially from the container with certainty after only a few pump strokes, and dry function testing of the entire pump is possible.

It is also possible without any problems to use the design of the valves 18, 58 according to the present invention in a metering and spray pump in which the container for the medium is made directly in one piece with the housing part 2 instead of having a screw cap 39.

While specific embodiments of the invention have been shown and described in detail to illustrate the application of the principles of the invention, it will be understood that the invention may be embodied otherwise without departing from such principles.

What is claimed is:

1. Metering/spray pump comprising:

a housing;

a bellow means connected to said housing and including a pump chamber, said bellows means being telescopingly movable relative to said housing for changing a volume of said pump chamber during telescopic movements;

a discharge seat on said housing and having a substantially round annular surface;

a discharge valve wall on a first end of said bellow means movable into and out of sealing contact with said discharge seat in a radial and axial direction, said discharge valve wall having a substantially annular sleeve-like shape for sealingly surrounding said substantially round annular surface of said discharge seat, said discharge valve wall being movable away from said discharge seat when pressure between said discharge valve wall and said discharge seat is greater than a pressure on a side of said discharge valve wall opposite said discharge seat;

a suction seat connected to a second end of said bellow means, said suction seat having a substantially annular hemispherical generated surface and defining a suction bore;

a suction valve wall movable into and out of contact with said suction seat in a radial and axial direction, said suction valve wall having an open edge sealing means for forming a seal between said suction valve wall and said suction seat when said suction valve wall is in contact with said suction seat, said suction valve wall having a substantially annular sleeve-like shape for sealingly surrounding said annular hemispherically generated surface of said suction seat, and a suction closing wall on said suction valve wall for closing one end of said substantially annular sleeve-like shape;

first connection web means connecting to said suction valve wall;

a connection ring connected to said first connection web means; and second connection web means for connecting said connection ring to said bellow means, said second connection web means, said second connection ring and said first connection web means being axially and radially elastic for movement of said suction valve wall away from said suction when a pressure in said pump chamber is less than a pressure in said section bore.

2. A pump in accordance with claim 1, wherein:

said bellows is made of an elastic plastic;

said housing is made of a dimensionally stable plastic;

said discharge seat is made in one piece with said housing and has a substantially conical shape in addition to said substantially round annular shape;

a medium is drawn into said pump chamber from between said suction seat and said suction valve wall, and said medium is pushed through said bellows and into an interior space between said discharge seat and said discharge valve wall; and said discharge valve wall has an open edge sealing means for forming a seal between said discharge valve wall and said discharge seat when said discharge valve wall is in contact with said discharge seat.

3. A pump in accordance with claim 1, further comprising:

an annular discharge shoulder between said bellow means and said discharge valve wall, said annular discharge shoulder extending substantially radially outward and being elastic; and another housing connected to said bellow means, said another housing being telescopically movable, with said bellow means, relative to said housing, and said another housing being made in one piece with said suction seat, said suction seat connected to said bellow means by said another housing.

4. A pump in accordance with claim 1, wherein:

said connection ring is connection to a suction section of said bellow means;

said first connection web means has three finger-like connection webs distributed in a circumferential direction; and said second connection web means has three finger-like connection webs distributed in a circumferential direction and staggered relative to said three finger-like connection webs of said first connection web means.

5. A pump in accordance with claim 1, further comprising:

support cam means for keeping pumping pressure away from said discharge valve wall during a pump stroke, said support cam means being located on said housing and contacting an inside of said bellow means during said pump stroke.

6. A pump in accordance with claim 1, further comprising:

a circumferential rib on an inside of a guide wall of said housing; and a sealing ring means for forming a sealing contact with said inside of said guide wall of said housing, said sealing ring means being connected to said bellow means and held in position on said inside wall of said housing by said circumferential rib.

7. A pump in accordance with claim 1, wherein:

said suction seat is located in a suction section of said bellow means, and is designed as a nipple-like hollow body extending into said suction section.

8. A pump in accordance with claim 1, wherein:

said suction bore has a diameter substantially half in size of a diameter of said suction valve wall.

9. A pump in accordance with claim 3, further comprising:

a guide wall on said another housing, said guide wall of said another housing having a portion of an inside surface defining an enlarged diameter surface;

annular rib means for being in contact with said inner surface of said guide wall of said another housing in a starting portion of a pump stroke and moving away from said enlarged diameter surface during another portion of said pump stroke, said annular rib means being connected to said bellow means.

10. A pump in accordance with claim 1, further comprising:

check valve means for stopping a flow of medium through said pump chamber when the metering/spray pump is in a start position, said check valve means having a check collar on said bellow means and a lower edge section on said housing, said check collar and said lower edge section being in sealing contact when the metering/spray pump is in said start position.

11. A pump in accordance with claim 10, wherein:

said bellow means has a cylinder wall designed as a lower extension and said check collar is connected to said lower extension of said bellow means; and said housing has a displacement body concentrically passing through said bellow means and said lower edge section is on said displacement body.

12. A pump in accordance with claim 3, wherein:

said bellow means has a cylinder wall designed as a lower extension, a length of said cylinder wall is substantially equal to a length of a pump stroke; and said cylinder wall is connectable to said another housing.

13. A pump in accordance with claim 10, wherein:

said lower edge section is guided in said cylinder wall with a small radial clearance during a pump stroke.

14. A pump in accordance with claim 10, wherein:

said displacement body is a displacement piston moving through said bellow means with a radial clearance.

15. A pump in accordance with claim 3, wherein:

said another housing has internal thread means for connecting to a container.

16. A pump in accordance with claim 9, further comprising:

a guide wall on said housing being telescopically guided on said guide wall of said another housing, said guide wall of said housing and said guide wall of said another housing having a length substantially equal to a length of said pump stroke; and telescopic limit means for stopping said relative telescopic movement farther than approximately said length of said pump stroke, said telescopic limit means having a collar on said guide wall of said housing and a collar on said guide wall of said another housing.

17. A pump in accordance with claim 10, wherein:

said housing has a guide wall and said displacement body is longer than said guide wall by approximately one pump stroke.

18. A pump in accordance with claim 6, further comprising:

another housing connected to said bellow means, said another housing being telescopically movable with said bellow means, relative to said housing, and said another housing being made in one piece with said suction seat, said suction seat connected to said bellow means by said another housing;

a guide wall on said another housing having an insertion collar means for pushing said sealing ring means pass said circumferential rib.

* * * * *